United States Patent [19]

Pav et al.

[11] 4,311,091

[45] Jan. 19, 1982

[54] RAPID-SEPARATION MOUNTING ARRANGEMENT FOR ROLLERS OF A CALENDERING MACHINE

[75] Inventors: Joseph Pav; Reinhard Wenzel, both of Krefeld, Fed. Rep. of Germany

[73] Assignee: Kleinewefers GmbH, Krefeld, Fed. Rep. of Germany

[21] Appl. No.: 54,614

[22] Filed: Jul. 3, 1979

[30] Foreign Application Priority Data

Jul. 13, 1978 [DE] Fed. Rep. of Germany ..... 2830733

[51] Int. Cl.[3] ..... B30B 3/04

[52] U.S. Cl. ..... 100/161; 100/170

[58] Field of Search ..... 100/47, 155 R, 161, 100/163 R, 164, 165, 166, 163 A, 167, 168, 169, 170

[56] References Cited

U.S. PATENT DOCUMENTS

| | | | |
|---|---|---|---|
| 2,861,504 | 11/1958 | Kane | 100/170 X |
| 3,016,819 | 1/1962 | Kupa | 100/170 X |
| 3,369,483 | 2/1968 | Muller | 100/170 X |
| 3,777,656 | 12/1973 | Muller | 100/170 X |

FOREIGN PATENT DOCUMENTS

| | | | |
|---|---|---|---|
| 1054953 | 4/1959 | Fed. Rep. of Germany | 100/163.8 |

*Primary Examiner*—Billy J. Wilhite
*Attorney, Agent, or Firm*—Peter K. Kontler

[57] ABSTRACT

A calendering machine or a similar machine which has a plurality of treating rollers arranged one above the other and movable in the vertical direction includes a structural unit for rapidly displacing the lowermost roller between its lifted position in which the rollers form treating nips with one another, and a lower position in which the rollers are spaced apart and define gaps between each other. The structural unit is connected to the bearing block of the lowermost roller and incorporates guides, upward movement limiting abutment surfaces for the bearing block, and a hydraulic cylinder-and-piston unit acting on the bearing block from below to displace the bearing block to its lifted position upon introduction of pressurized hydraulic fluid medium into its working chamber, and to permit the bearing to rapidly descend to its lower position upon discharge of the hydraulic fluid medium from its working chamber. The guides and the abutment surfaces are provided either on integral portions of, or on elements rigidly connected to, a supporting block of the structural unit, on the one hand, and the bearing block, on the other hand.

12 Claims, 7 Drawing Figures

RAPID-SEPARATION MOUNTING ARRANGEMENT FOR ROLLERS OF A CALENDERING MACHINE

BACKGROUND OF THE INVENTION

The present invention relates to a rapid-separation mounting arrangement for rollers in general, and more particularly to an arrangement of this type for use in calendering machines.

It is well known, particularly in the field of constructing calendering machines, to mount a plurality of treating, especially calendering, rollers for rotation in individual bearing blocks. The bearing blocks, in turn, are mounted on stationary guides fixed to a support or frame of the machine, for movement toward and away from one another with attendant movement of the rollers together and apart. Especially in a calendering machine, the guides extend substantially vertically so that the rollers are arranged one above the other, and so are the individual bearing blocks for the respective rollers. In this context, it has been proposed to employ a pressing arrangement mounted on the support and acting on the bearing blocks of the uppermost roller in the downward direction. Then, it is also known to associate a cylinder-and-piston unit with each of the bearing blocks of the lowermost roller, the cylinders of each of these units are being stationarily mounted on the support, while the pistons of these units are displaceable from a first position in which they lift the bearing blocks, under the influence of a pressurized hydraulic fluid medium in the cylinders, upwardly to positions of abutment against stationary abutment surfaces and downwardly following a reduction in the pressure of the pressurized fluid medium to a second position in which a gap exists between all of the above-mentioned rollers.

A calendering machine of this kind is disclosed, for instance, in the U.S. Pat. No. 2,861,504. This calendering machine includes two upright supports, each at the one side of the machine and each including two columns which are connected at their upper ends by a yoke and at their lower ends by a base. Guides are provided at the inner sides of the columns, and the bearing blocks of all of the rollers are slidingly guided on these guides. Moreover, abutments provided with the above-mentioned abutment surfaces are so connected to the guides as to be positively stationarily retained thereon. A mechanical pressing arrangement is supported on the upper yoke. The cylinder-and-piston unit is arranged in the base. When the piston of the unit presses the bearing blocks of the lowermost roller in the upward direction, the bearing blocks are positively clamped between the piston and the abutment surface so that there is obtained a defined operating position for the lowermost roller. However, the lowermost roller can be rapidly lowered out of this operating position.

As advantageous as this arrangement may be in all other respects, it exhibits the drawback that the forces required for the fixation of the operating position of the lowermost roller are transmitted to the upright columns of the supports. Hence, these columns have to be so dimensioned as to be able to withstand the loads resulting from the above-mentioned fixation forces in addition to the working loads which are required for the treatment of the web of material treated by the rollers. Inasmuch as the columns of the upright support have to be machined in order to make the guides, there result relatively large tolerances. The lateral play which is caused by such large tolerances results in oscillations in the first or operating positions of the lower rollers when, based on irregularities of the surfaces of the rollers or non-uniform thickness of the material to be handled, the various parts are excited into oscillation. Large tolerances also make it difficult, at least in part, to properly set or adjust the abutments. This known arrangement is not suited for the supports which are in use nowadays and which include only a single column.

There is further known a calendering machine disclosed in German Pat. No. 2,010,322 in which each of the upright supports includes only one column and thus only one guide for the rollers, which extends over the entire height of the respective column. In order to make it possible to guide the bearing block of the lowermost roller on both sides, a block with a second guide is stationarily mounted at the outer side of the base. The cylinder which is arranged in the base is provided with a lid that is rigidly connected thereto, the lid forming an abutment surface for a step provided on the piston.

In this construction, only the piston is positively guided. The bearing blocks of the lowermost rollers merely lie on the piston under the influence of the forces exerted thereon by the rollers and/or associated bearing blocks situated above the same. To this, there are to be added, even here, the manufacturing tolerances and deviations in parallelism of the two mutually independent guides. As a result of this freedom of movement of the lowermost roller, there are encountered operating disturbances in the form of intense vibrations and rattling phenomena. They cause deformation and finally damaging of the set of rollers and, as a result of this, also of the product to be treated such as, for instance, a paper web. The criticality of these disturbances increases with the length of the rollers and with the rate of their speed of rotation. As a result of this, any further technical development of machines of this type is considerably limited.

The above-discussed disadvantages become even more pronounced when a calendering machine with a heretofore non-displaceable lowermost roller is to be converted in a calendering machine capable of rapid separation of the individual rollers. More particularly, in a case like this, the one guide which is provided on the upright support must be manufactured in situ. This, of necessity, results in even greater tolerances than those obtained when the guide is manufactured in the manufacturing plant.

OBJECTS AND SUMMARY OF THE INVENTION

It is an object of the invention to provide a treating machine, particularly a calendering machine, which does not exhibit the above-discussed disadvantages of conventional machines of this type.

Another object of the instant invention is to develop a machine of the type here under consideration in which it is possible to obtain a secure fixation of the lowermost roller.

A further object of the invention is to so construct the machine that it is possible to rapidly separate the treating rollers thereof whenever needed.

An additional object of the invention is to design a rapid-separation arrangement for use in a calendering machine, which arrangement can be used regardless of the shape of the upright support, whether in newly produced machines, or as a replacement for use in existing machinery.

A concomitant object of the present invention is to provide a rapid-separation arrangement which is simple in construction, inexpensive to manufacture, easy to operate, and reliable.

One feature of the present invention resides in the provision of a machine for treating elongated webs of flexible material, particularly for calendering paper webs, which, comprises a support; elongated guiding means on the support extending in a substantially vertical direction; a plurality of treating rollers; means for mounting the treating rollers above each other on the guiding means for displacement longitudinally of the latter; an additional treating roller; and at least one structural unit mounted below the plurality of treating rollers in its operative position and including first means for mounting and guiding the additional treating roller on the support for displacement substantially parallel to the aforementioned direction, and second means for displacing at least the additional treating roller at least upwardly toward the lowermost one of the plurality of treating rollers. Advantageously, the machine further includes an additional structural unit similar to the above-mentioned structural unit, the two structural units being spaced from one another axially of the additional treating roller. It is further advantageous when the mounting means and the first means include two bearing blocks for each of the treating rollers, and when the first means of each of the structural units incorporates one of the bearing blocks for the additional treating roller. There may further advantageously be provided means for limiting the extent of upward movement of at least one of the treating rollers, particularly of the additional treating roller, in which case the limiting means is advantageously incorporated in at least one of the structural units.

When using a structural unit constructed as discussed above, it is no longer necessary to provide guides or guiding means on the support for displaceably mounting the bearing blocks of the lowermost or additional roller. On the other hand, it is possible to manufacture the guides of the structural unit with a much higher degree of accuracy and to also orient the same within the structural unit in exact parallelism with one another. Inasmuch as the bearing block of the additional treating roller is positively clamped between the second means (which is preferably constituted by a piston member of a cylinder-and-piston unit incorporated in the structural unit) and the limiting means (which includes at least one abutment surface), and lateral play is substantially avoided, it is possible to completely eliminate vibrations and rattling phenomena. Furthermore, it is no longer necessary to increase the dimensions of the support inasmuch as the forces which act on the limiting means are not transmitted to the support. Rather, these forces can be applied relatively close to the force line defined by the piston of the cylinder-and-piston unit, so that there is obtained a very compact system. Inasmuch as the structural unit incorporates all of the components which are needed for the fixation of the lowermost or additional treating roller in its operative position and for the lowering of this additional roller, it is no longer necessary to provide guides on the support, or abutments provided on the support. Consequently, the structural unit is completely independent of the configuration of the support. The structural unit can be completely manufactured in the manufacturing plant. Therefore, it is not necessary to precisely mill or carefully assemble any guides during refurbishing or restructuring operations.

It is especially advantageous when the structural unit includes a mounting block which rests on a planar support surface of the base of the support. The mounting block is securely pressed against the flat support surface by the vertical forces acting thereon. Relatively simple securing means are required for preventing lateral shifting of the structural unit.

Furthermore, the structural unit may include a socket equipped with an abutment surface, into which the cylinder of the cylinder-and-piston unit constituting the second means is inserted up to abutment against this abutment surface. When the cylinder is introduced into this socket it is also securely held by the vertical forces acting thereon. In many instances, it is possible to dispense with any other connecting means.

Furthermore, the structural unit may be equipped with guiding elements which, in addition to the guides, are also provided with the abutment surfaces. This results in a further simplification. In one embodiment, the guides are provided on guiding rods, especially cylindrical bolts, which pass through the mounting block. Inasmuch as the guiding rods pass through the mounting block, there is obtained an especially exact guidance. More particularly, it is possible to very accurately fit the bores in the mounting block to the associated cylindrical bolts. In this connection it is advantageous when the abutment surfaces are provided on enlarged heads of the guiding rods.

In a modified embodiment of the present invention, the guides are provided on two guiding walls which are situated at the two sides of the mounting block. These guides can be configurated in a customary manner as grooves, ribs or the like. Herein, two lugs overlapping the mounting block can be provided on each guiding wall, the lugs being provided with the abutment surfaces. Under these circumstances, pins or similar elements cooperating with the abutment surfaces can pass through the mounting block. This facilitates the assembly, inasmuch as the pins can be introduced into the mounting block after the introduction of the mounting block between the guiding walls.

A particularly simple construction is obtained when the mounting block is rigidly connected with the guiding rods, guiding walls or other guiding elements and when it is provided with the socket for the reception of the cylinder of the cylinder-and-piston unit. Inasmuch as the cylinder can be introduced into the socket without any special connection, it is merely necessary, in the simplest case, to connect guiding elements with the support block.

In a third embodiment, the construction is such that the guides and/or abutment surfaces are arranged outwardly of the cylinder of the cylinder-and-piston unit and that they cooperate with legs of the mounting block which overlap the cylinder. In this manner, there is obtained a very compact structural unit with extraordinarily short force-transmitting arms.

It is especially advantageous when the guides are made as vertical grooves or slots in which the legs of the mounting block extend, when the abutment surfaces are provided on abutment elements inserted into transverse recesses, and when the legs are provided at their interior with recesses into which the abutment elements extend. Herein, each abutment element can be introduced into its transverse recess after the assembly of the mounting block and of the cylinder.

Furthermore, the support block can be equipped with the socket for the cylinder of the cylinder-and-piston unit and, outwardly of the same, with recesses for the reception and outward guidance of the legs of the mounting block. This results in an additional outward guidance for the legs of the mounting block.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
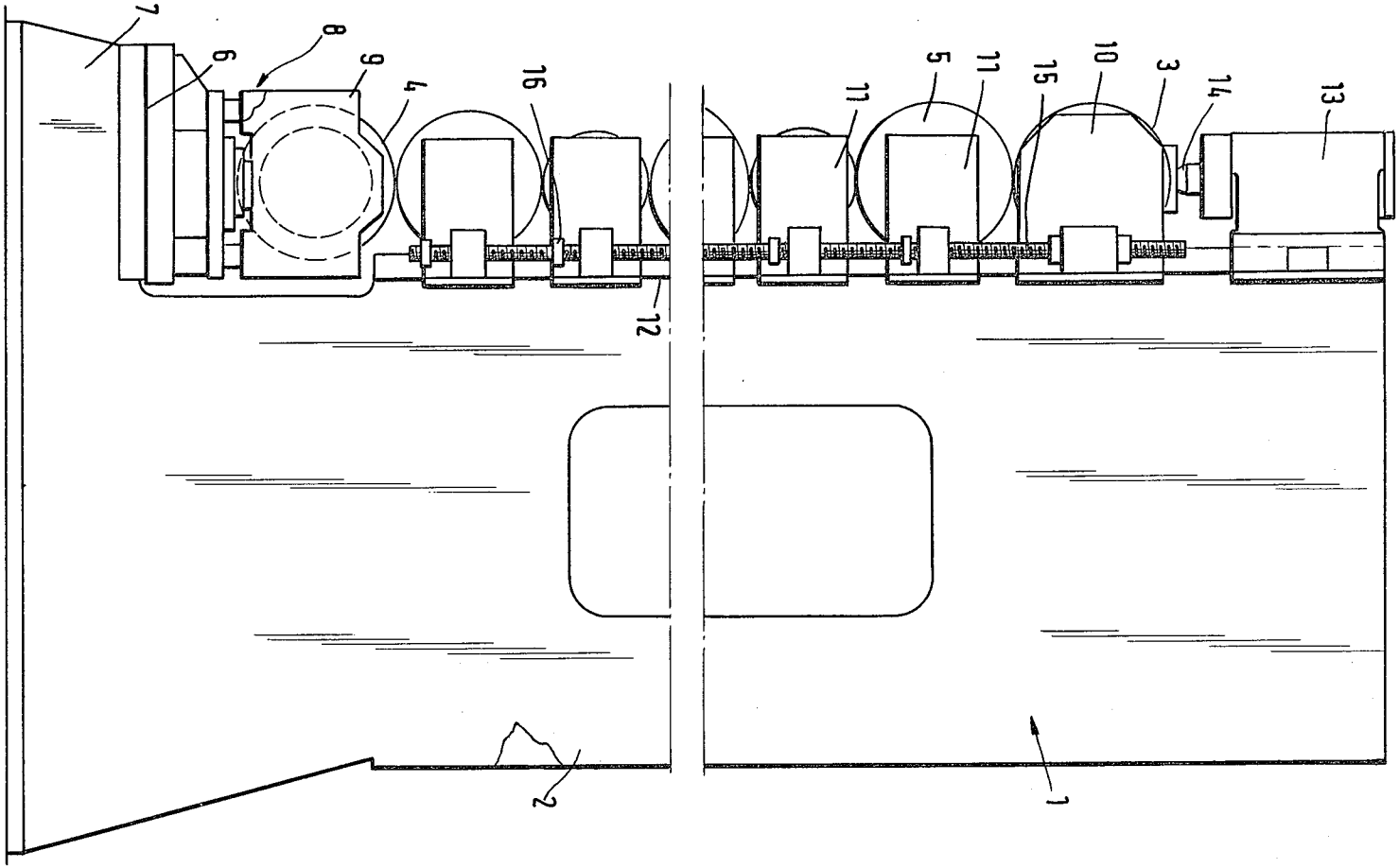
FIG. 1 is a somewhat diagrammatic side elevational view of a calendering machine which is constructed in accordance with the invention.

Referring now to the drawing in detail, and first to FIG. 1, the reference numeral 1 designates a calendering machine in its entirety. The calendering machine 1 includes two upright supports 2 each including an upright column, and a plurality of rollers, including an uppermost roller 3, a lowermost roller 4, and intermediate rollers 5.

The illustrated support 2 includes a base 7 having a flat or planar support surface 6. A structural unit 8 is arranged and supported on the planar support surface 6 of the base 7, the structural unit 8 being associated with a bearing block 9 for the lowermost roller 4 in a manner which will be discussed below. A bearing block 10 for the uppermost roller 3 and the bearing blocks 11 for the intermediate rollers 5 are slidingly mounted on continuous vertically oriented guiding rails 12 of the supports 2 for movement along the same.

A hydraulic pressing arrangement 13 is mounted on the illustrated support 2 at the upper end of the respective guiding rail 12 and includes a piston 14 which is rigidly connected with the corresponding bearing block 10.

The structural unit 8 renders it possible to hold the lowermost roller 4 in the illustrated first position, and to lower the same very rapidly to a second position as will more fully appear from the following discussion. A suspension spindle 15 is connected to the bearing block 10 for the uppermost roller 3 and is provided with a number of abutments 16. These abutments 16 render it possible to achieve such a lowering of the intermediate rollers 5 upon the lowering of the lowermost roller 4 that a gap develops between each pair of neighboring rollers 3, 4 and 5.

Figure 2:
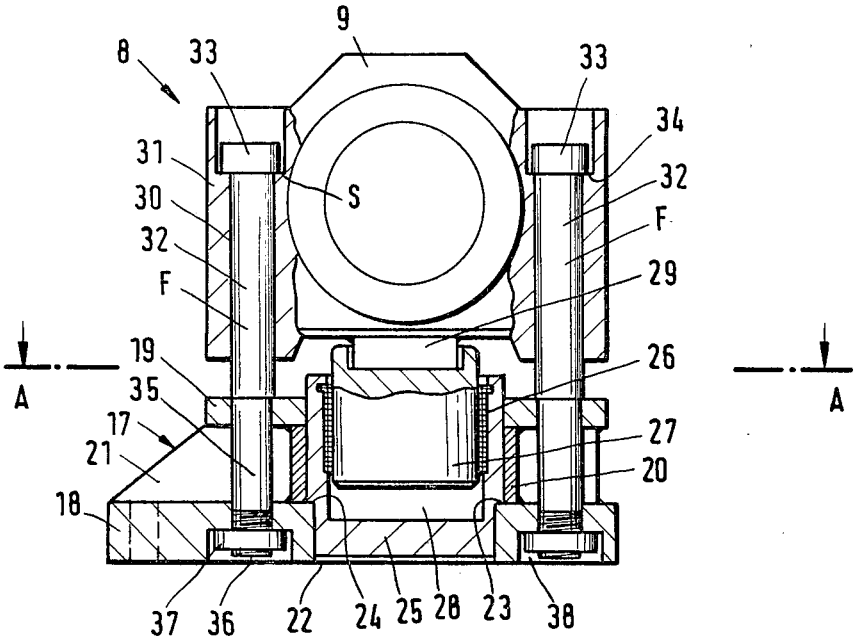
FIG. 2 is a vertical section through a structural unit of the present invention which can be used in the machine of FIG. 1.
Figure 3:
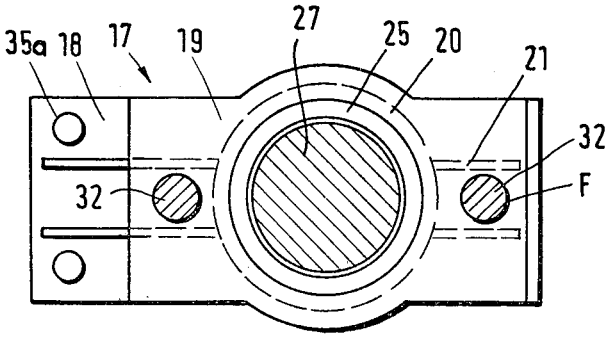
FIG. 3 is a horizontal section along the line A—A of FIG. 2.

Turning now to FIG. 2, the structural unit 8 includes a support block 17 which incorporates a lower plate 18, an upper plate 19, a ring 20, and a plurality of rib-shaped reinforcing elements 21. The lower plate 18 rests on the flat supporting surface 6 of the base 7 of the respective support 2, and can be connected to the base 7 by means of screws extending through bores 35*a*. The ring 20, together with circular recesses or cut-outs in the plates 18 and 19, constitutes a socket 22 having an abutment surface 23. A cylinder 25 having a shoulder 24 is inserted into the socket 22. The cylinder 25 accommodates a piston 27 which is guided in the cylinder 25 by means of a sealing element 26. The piston 27 can be subjected to the pressure of a pressurized fluid medium which can be introduced, in a conventional manner, into a working space or chamber 28 of the cylinder 25. The piston 27 acts, via an intermediate member 29, on the lower side of the bearing block 9.

The bearing block 9 has two spaced aparat portions 31 with bores 30 which are enlarged at their upper ends to define shoulders 34. Each of these bores 30 accommodates a guiding rod 32 in the form of a cylindrical bolt which constitutes a guide F. Each guiding rod 32 has a head 33 on its upper end, the head 33 having an abutment surface S on its lower end which abuts against the respective shoulder 34. A smaller-diameter portion 35 of each of the guiding rods 32 passes through the plates 18 and 19. The guiding rods 32 are tightened or pre-tensioned by means of nuts 37 which mesh with the threads 36 of the respective guiding rods 32. Each nut 37 is received in a depression 38 provided at the underside of the plate 18. In this manner, the guiding rods 32 are connected to the support block 17.

When the pressurized fluid medium is admitted into the working space 28 of the cylinder 25, it displaces the piston 27 to the position illustrated in FIG. 2 in which the shoulders 34 of the bearing block 9 abut the abutment surfaces or shoulders 35 of the guiding rods 32. Inasmuch as the guide F is very accurate, there is obtained a precisely defined position of the bearing block 9, which is tantamount or comparable to a rigid connection of the bearing block 9 to the support 2. This position is maintained during the operation of the machine 1, inasmuch as the pressurized fluid medium exerts a force on the piston 27 and, via the same, on the bearing block 9 which is greater than the oppositely oriented force acting on the bearing block 9 as a result of the pressure of the pressing arrangement 13 and the weight of the rollers 3 and 5 and the associated bearing blocks 10 and 11. When the pressure of the pressurized medium in the working space 28 is relieved by discharging some of the pressurized medium from the working space 28, the bearing block 9 rapidly descends along the guide F so that the remaining rollers 5 can quickly follow suit under the influence of gravity.

The illustrated structural unit 8 can be completely manufactured and even assembled already in the manufacturing plant. However, it can also be transported in disassembled condition and be assembled at the location of intended use with the same degree of precision.

Figure 4:
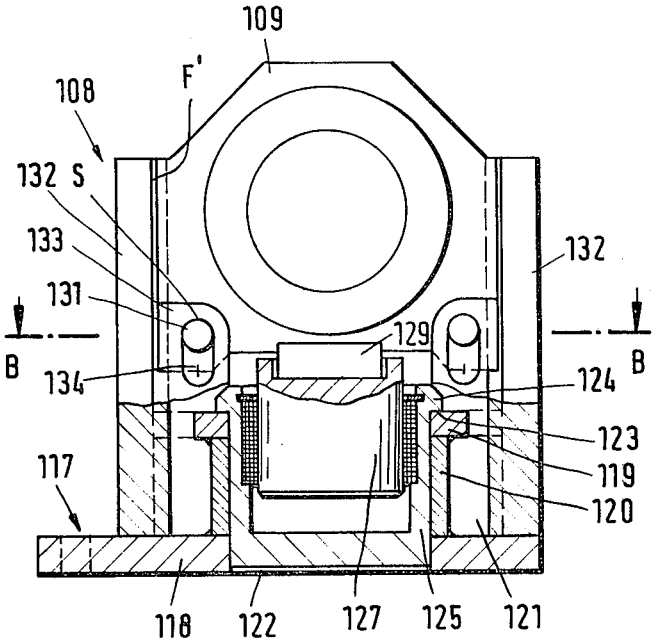
FIG. 4 is a view similar to FIG. 2 but of a modified structural unit of the present invention.
Figure 5:
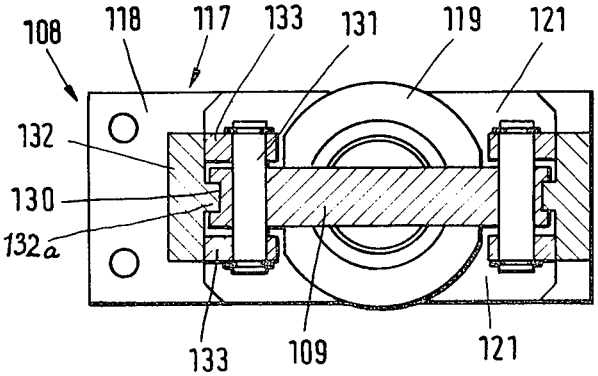
FIG. 5 is a horizontal section taken on line B—B of FIG. 4.

The embodiment illustrated in FIGS. 4 and 5 is similar to that discussed above in so many respects that the same reference numerals, but raised by 100 to avoid confusion, have been used to designate the various components thereof. Thus, the structural unit has been denoted by the reference numeral 108, and so on. The structural unit 108 includes a bearing block 109 which incorporates a support block 117. The support block 117 consists of a lower plate 118, an upper plate 119, a ring 120, as well as lateral supporting elements 121. A socket 122 constituted by the ring 120 and circular or cylindrical cut-outs in the plates 118 and 119 accepts a cylinder 125. The cylinder 125 includes a flange 124 which abuts against an abutment surface 123 which is constituted by the upper surface of the plate 119. A piston 127 acts, via an intermediate element 129, on the lower side of the bearing block 109.

Guides F' are provided on guiding walls 132 which are rigidly connected to the reinforcing elements 121, for instance, by screws or the like. Each of the guiding walls 132 includes a rib 132*a* which extends into a corresponding guiding groove 130 of the bearing block 109. Two lugs 133 are rigidly connected to each of the lateral walls 132. Each of the lugs 133 is provided with a slot 134, the upper ends of which define abutment surfaces S. Pins 131 pass through the bearing block 109 and into the slots 134. When the piston 127 displaces the bearing block 109 to the illustrated position, the pins 131 contact and press against the abutment surfaces S.

Even this structural unit can be completed in the manufacturing plant and transported to the location of use in that condition, or can be brought to the location of use in disassembled condition and assembled thereat by connecting the guiding walls 132 by the aforementioned screws, insertion of the cylinder 125, introduction of the bearing block 109, and finally by the insertion of the pins 131.

Figure 6:
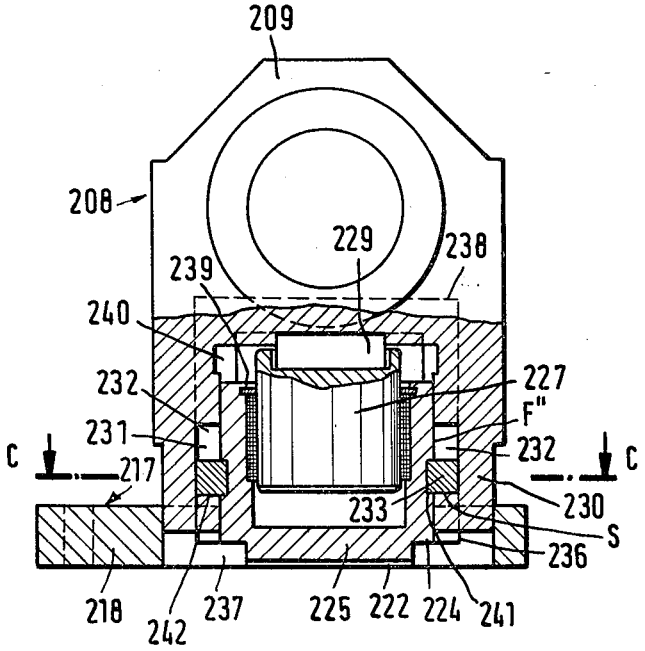
FIG. 6 is a view similar to those of FIGS. 2 and 4 but of a further modification of the structural unit.
Figure 7:
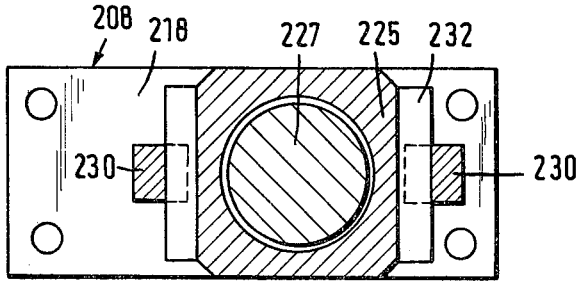
FIG. 7 is a horizontal section taken on line C—C of FIG. 6.

In the modified embodiment illustrated in FIGS. 6 and 7, the same reference numerals have been used again to designate the corresponding parts, but this time being raised by 200. The structural unit 208 of this embodiment serves to manipulate a bearing block 209. In this embodiment, the mounting or supporting block 217 includes only a lower plate 218 in which there is formed a socket 222 with an abutment 224. A cylinder 225 accommodating a piston 227 is inserted into the socket 222. The piston 227 acts on the bearing block 209 via an intermediate element 229. In the event that the socket 222 constructed in this manner gives too little guidance or lateral support for the cylinder 225, the latter can be additionally affixed to the supporting block 217 by means of screws. A guide F'' is formed in this embodiment in such a manner that an external portion 236 of the cylinder 225 is provided, on both sides, with a vertical groove 232. Legs 230 of the bearing block 209 extend into these grooves 232. Recesses or similar cut-outs 237 in the plate 218 serve for guiding the legs 230 even at their outer sides. The cylinder 225 extends up to level 238, but it is provided with a diagonal groove 240 which extends only to the level 239 and has a width exceeding that of the bearing block 209, so that the legs 230 are guided over a relatively large length. Abutment elements 233 are supported in transverse grooves 241 and they are provided, at their undersides, with abutment surfaces S. The legs 230 are formed with recesses 231 which overlap the abutment elements 233 and define contact surfaces 242 at their ends, the contact surfaces 242 cooperating with the abutment surfaces S. The abutment elements 233 are introduced into the associated transverse grooves 241 in the last phase of the assembly.

Each of the structural units 8, 108 and 208 can be used to advantage either for newly constructed machines, or for already existing machinery which is to be rebuilt. It can be used in calendering or similar machines which have only a single upright support, or even in machines which have two upright supports.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. A machine for treating elongated webs of flexible material, particularly for calendering paper webs, comprising a support; elongated guiding means provided on said support and extending in a substantially vertical direction; a plurality of treating rollers; means for mounting said treating rollers above each other on said guiding means for displacement longitudinally of the latter; an additional treating roller; a pair of similar structural units spaced from one another, as considered in the axial direction of said additional treating roller, and mounted below said plurality of treating rollers in the operative positions thereof, each of said units including first means for mounting and guiding said additional treating roller on said support for displacement in substantial parallelism with said direction and second means for displacing at least said additional treating roller at least upwardly toward the lowermost of said plurality of treating rollers, said first means including at least two guides in each of said structural units and each situated at one side of the axis of said additional treating roller, said mounting and said first means including two bearing blocks for each of said treating rollers and said first means of each of said structural units incorporating one of the bearing blocks for said additional treating roller; means mounted on said support and operative to urge the bearing blocks for the uppermost roller of said plurality of treating rollers downwardly, the bearing blocks for said plurality of treating rollers being freely displaceably mounted on said guiding means for gradual entrainment of said plurality of treating rollers for joint displacement with said additional treating roller and with one another in upward direction, each of said second means including a cylinder-and-piston unit including a cylinder member and a piston member, one of said members being stationary relative to said support and the other of said members being movable relative to said support and acting on the bearing block of the respective structural unit, and means for admitting a pressurized fluid medium into the cylinder member to act on the respective other member with a force which is sufficient to displace the respective other member upwardly and to thereby displace said additional treating roller toward the lowermost treating roller of said plurality of treating rollers and then gradually displace said plurality of treating rollers toward one another, and for relieving the pressure in the cylinder member to thus allow said treating rollers to gradually and rapidly assume spaced-apart positions in which gaps are present between said treating rollers; and means for limiting the extent of upward displacement of at least one of said treating rollers, said limiting means being incorporated in at least one of said structural units.

2. A machine as defined in claim 1, wherein said support has a base extending under said plurality of treating rollers and having a supporting surface, said units resting on said supporting surface.

3. A machine as defined in claim 1, wherein said second means includes a cylinder-and-piston unit having a cylinder member and a piston member one of which is stationary and the other of which is movable relative to said support, and means for admitting a pressurized fluid medium at a predetermined pressure into said cylinder member to displace the movable member, each unit of said pair further including a socket for receiving said stationary member and having an abutment surface against which said stationary member abuts upon introduction into said socket.

4. A machine as defined in claim 1, wherein each of said units includes a mounting block attached to said support and has a receiving socket, said first means including at least one guide rigidly connected to the respective mounting block and said second means including a cylinder-and-piston unit having a cylinder member and a piston member, one of said members being received in the respective socket so as to be stationary relative to the respective mounting block and the other member being movable relative to said one member under the influence of pressurized fluid.

5. A machine for treating elongated webs of flexible material, particularly for calendaring paper webs, comprising a support; elongated guiding means provided on said support and extending in a substantially vertical direction; a plurality of treating rollers; means for mounting said treating rollers above each other on said guiding means for displacement longitudinally of the latter; an additional treating roller; and at least one unit mounted below said plurality of treating rollers and including first means for mounting and guiding said additional treating roller on said support for displacement in substantial parallelism with said direction, and second means for displacing at least said additional treating roller at least upwardly toward the lowermost roller of said plurality of treating rollers, said first means including at least one guide having a guiding surface and an abutment surface constituting means for limiting the extent of upward movement of said additional treating roller.

6. A machine as defined in claim 5, wherein said first means includes at least one bearing block supporting said additional treating roller and having at least one bore, said guide being configurated as a guiding rod and being accommodated in said bore.

7. A machine as defined in claim 6, wherein said guiding rod has an enlarged head portion having said abutment surface.

8. A machine for treating elongated webs of flexible material, particularly for calendering paper webs, comprising a support; elongated guiding means provided on said support and extending in a substantially vertical direction; a plurality of treating rollers; means for mounting said treating rollers above each other on said guiding means for displacement longitudinally of the latter; an additional treating roller; and at least one unit mounted below said plurality of treating rollers in its operative position and including first means for mounting and guiding said additional treating roller on said support for displacement in substantial parallelism with said direction, and second means for displacing at least said additional treating roller at least upwardly toward the lowermost roller of said plurality of treating rollers, said first means including at least one bearing block supporting said additional treating roller and having two pins each extending outwardly beyond said bearing block, and two guides each formed on a guiding wall each of which is arranged at one side of said bearing block and includes a lug overlapping said bearing block and having an abutment surface engaged by said pins to limit the extent of upward movement of said bearing block.

9. A machine of treating elongated webs of flexible material, particularly for calendering paper webs, comprising a support; elongated guiding means provided on said support and extending in a substantially vertical direction; a plurality of treating rollers; means for mounting said treating rollers above each other on said guiding means for displacement longitudinally of the latter; an additional treating roller; and at least one unit mounted below said plurality of treating rollers in its operative position and including first means for mounting and guiding said additional treating roller on said support for displacement in substantial parallelism with said direction, and second means including a cylinder-and-piston unit for displacing at least said additional treating roller at least upwardly toward the lowermost roller of said plurality of treating rollers, said first means including a bearing block having legs overlapping said cylinder-and-piston unit, and guides arranged outwardly of said cylinder-and-piston unit and cooperating with said legs.

10. A machine as defined in claim 9 further comprising means for limiting the extent of upward displacement of said bearing block also arranged outwardly of said cylinder-and-piston unit and cooperating with said legs.

11. A machine as defined in claim 10, wherein said guides are constituted by vertical grooves, said legs extending into said vertical grooves and said limiting means being constituted by abutment elements received in transverse apertures, each of said legs including a recess at its inner surface which accommodates the respective abutment element.

12. A machine as defined in claim 9, wherein said unit includes a mounting block having a socket for partially receiving said cylinder-and-piston unit and a plurality of depressions located outwardly of said socket and guidingly receiving said legs.

* * * * *